United States Patent [19]

Yen

[11] 4,257,035

[45] Mar. 17, 1981

[54] ALARM CIRCUIT FOR GENERATING SYLLABLE-PAUSE ALARM CODES

[76] Inventor: Anderson Yen, 4011 Cranford Cir., San Jose, Calif. 95124

[21] Appl. No.: 90,254

[22] Filed: Nov. 1, 1979

[51] Int. Cl.[3] ..... G08B 3/00

[52] U.S. Cl. ..... 340/384 E; 340/384 R; 340/52 F

[58] Field of Search ..... 340/52 F, 384 E, 384 R; 84/1.01, 1.03, 1.24; 179/15 A, 159

[56] References Cited

U.S. PATENT DOCUMENTS

| | | | |
|---|---|---|---|
| 4,000,489 | 12/1976 | Bench | 340/384 E |
| 4,193,060 | 3/1980 | Slavin | 340/52 F |

*Primary Examiner*—Harold I. Pitts
*Attorney, Agent, or Firm*—Jack M. Wiseman

[57] ABSTRACT

An alarm circuit for generating syllable-pause alarm code signals comprising an alarm. Controlling the operation of the alarm are first and second switching circuits. A primary code generator controls the operation of the first switching circuit for operating the alarm to produce a primary syllable-pause alarm code. The operation of the primary code generator is controlled by the application of a voltage resulting from an alarm condition. A secondary syllable circuit is also connected to the first switching circuit to control the operation thereof, which, in turn, controls the operation of the alarm to turn on the alarm for a short time duration during the pause portion of the syllable-pause alarm code. The operation of the secondary syllable circuit is controlled by the application of voltage resulting from an alarm condition. The second switching circuit is normally operated to render the alarm operative. The operation of a secondary pause circuit controls the operation of the second switching circuit to turn off the alarm for a short time duration during the syllable portion of the syllable-pause alarm code. The operation of the secondary pause circuit is controlled by the application of voltage resulting from an alarm condition. Different alarm conditions will result in a diode steering network applying the voltage resulting from an alarm condition to generate different discrete syllable-pause alarm codes.

24 Claims, 2 Drawing Figures

ALARM CIRCUIT FOR GENERATING SYLLABLE-PAUSE ALARM CODES

BACKGROUND OF THE INVENTION

The present invention relates in general to code alarm circuits, and more particularly to a code alarm circuit producing syllable-pause alarm codes.

Heretofore, Floyd Bell Associates, Inc. of Columbus, Ohio, sold multi-sound alarms, such as Models ML 200 series, that produced a continuous tone, or a continuous tone and beep, or a continuous tone and warble. Thus, one alarm generated more than one distinctive signal. The 2300 series of alarms sold by the same company generated three alarm modes.

The audio signal devices sold by the Cybersonic Division of C. A. Briggs Company of Glenside, Pa., generated distinctive sounds. The Cybertone 4 model generated a yodel, pulsed, continuous or yeow sound. The Cyberblast model generated seven distinct sounds based on various frequency rates and the Barnshee model generated four distinct sounds.

In the patent to Hoerz et al., U.S. Pat. No. 3,872,470, issued on Mar. 18, 1975, for Audible Signal Generating Apparatus Having Selectively Controlled Audible Output, there is disclosed an audible alarm generating circuit in which transistor switching circuits connect a crystal transducer to a direct current supply. The crystal transducer is in series with the crystal transducer. Each transistor switching circuit is controlled by an independent multivibrator oscillator. One oscillator controls one transistor switching circuit in order for the crystal transducer to generate a sound at a given frequency. The other oscillator controls the other transistor switching circuit in order for the crystal transducer to be selectively turned on and off to generate the sound of a given frequency at a pulsing rate.

The patent to Swanson et al., U.S. Pat. No. 4,001,716, issued on Jan. 4, 1977, for Variable Frequency Digital Oscillator discloses a digital oscillator. The output frequency of the digital oscillator is controlled by an output pulse from an output multivibrator circuit. To control the output pulse of the output multivibrator circuit are a plurality of multivibrators with discretely different pulse widths. Period select circuits have voltages selectively applied thereto to gate selectively the plurality of multivibrators for applying the output pulses thereof to the output multivibrator. The multivibrator which is selectively gated for application to the output multivibrator selects the output frequency of the digital oscillator.

The patent to Bench, U.S. Pat. No. 4,000,489, issued on Dec. 28, 1976, for Dual-Mode Waveform Generator discloses a single oscillator operated to generate different audio sounds. The patent to Bench employs a voltage controlled oscillator. The voltage controlled oscillator generates different sounds through the combination of a pulse generator and a step generator.

In the patent to Kawai et al., U.S. Pat. No. 3,686,583, issued on Aug. 22, 1972, for Signal Generator For A Flasher Type Direction Indicator, there is disclosed a signal generator for directional indicating lamps that has a first integrating circuit and a first logic circuit to produce an output signal when operating voltages are applied thereto. In addition, the signal generator includes a second integrating circuit and a second logic circuit to produce an output signal when operating voltages are applied thereto. The output of each logic circuit is coupled to the common inputs of the other integrating and logic circuits so that the indicator lamp is flashed on and off by the output signal of the second logic circuit.

Other patents of interest are: U.S. Patent to Carroll, U.S. Pat. No. 3,930,123; U.S. Patent to Wanless, U.S. Pat. No. 3,735,277.

SUMMARY OF THE INVENTION

An alarm circuit for generating syllable-pause alarm code signals in response to the application of a voltage resulting from an alarm condition. The alarm circuit comprises an alarm operatively controlled by a first and second switching circuit. A primary code generator in response to the application of the voltage resulting from an alarm condition controls the operation of the first switching circuit for the alarm to produce a primary alarm code. A secondary syllable circuit is connected to the first switching circuit to control the operation thereof for turning the alarm on for a short time duration during the pause portion of the primary alarm code in response to the application of the voltage resulting from the alarm condition. A secondary pause circuit is connected to the second switching circuit to control the operation thereof for turning the alarm off for a short time duration during the syllable portion of the basic alarm code in response to the application of the voltage resulting from the alarm condition. Different alarm conditions will result in the application of the voltage resulting from an alarm condition to generate different syllable-pause alarm codes.

A feature of the present invention is that each alarm condition results in an application of an alarm voltage to a steering network at various locations dependent on the alarm condition to generate a syllable-pause alarm code representative of the alarm condition.

Another feature of the present invention is the generation of a primary syllable-pause alarm code in which the syllable portion of the alarm code is turned-off for a short time duration and the pause portion of the alarm code is turned on for a short time duration to provide a plurality of various syllable-pause alarm codes, each of which is representative of a different preselected alarm condition.

DESCRIPTION OF THE PREFERRED EMBODIMENTS

Figure 1:
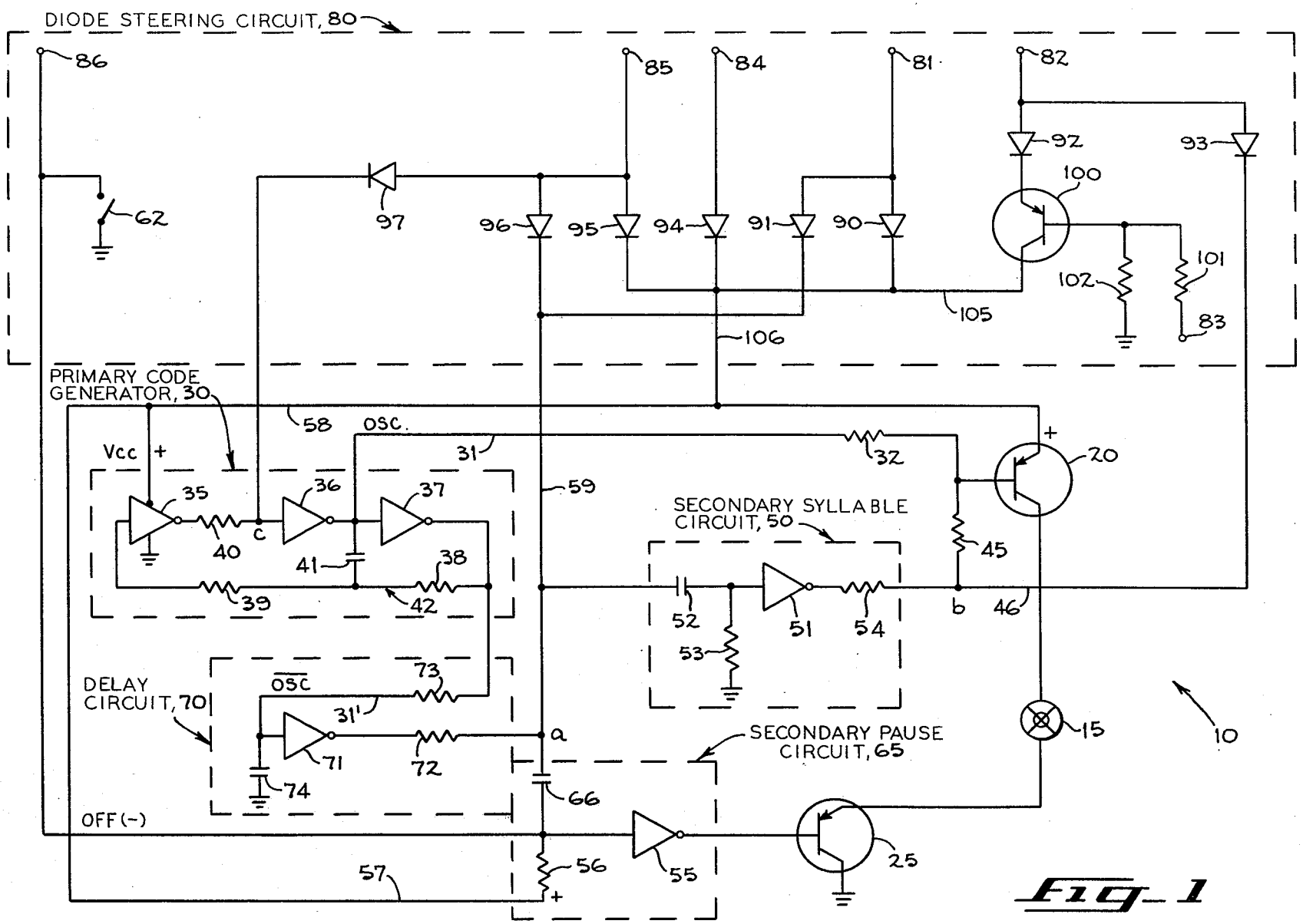
FIG. 1 is a schematic diagram of an alarm circuit for generating syllable-pause alarm codes embodying the present invention.

Illustrated in FIG. 1 is an alarm circuit 10 embodying the present invention for generating syllable-pause alarm codes representative of various alarm conditions upon the application of a voltage resulting from an alarm condition. The alarm circuit 10 comprises a suitable alarm 15. In the preferred embodiment, the alarm 15 is an audio alarm of the buzzer type sold by Citizen American Corporation of Santa Monica, Calif., as Model SMB-12; by Products Unlimited of Dayton, Ohio, as Model Al-122; by Shigato Industries, Inc., of New York, N.Y., as Model SMBW-12; and by Star Electronics, Inc., as Model CMB-12.

Controlling the operation of the alarm 15 are switching circuits 20 and 25. The switching circuit 20, which is in the form of a conventional switching transistor 20, is connected in series with the alarm 15. Similarly, the switching circuit 25, which is in the form of a conventional switching transistor, is connected in series with the alarm 15. The alarm 15 is energized when the transistors 20 and 25 conduct simultaneously and is deenergized when either the transistor 20 or the transistor 25 is not conducting.

A primary code generator 30 is connected to the transistor 20 over the following path: conductor 31, resistor 32 and the base electrode of the transistor 20. The transistor 25 is normally conducting in a manner to be described hereinafter. When the primary code generator 30 is operating, the switching circuit 20 under the control of the primary code generator 30 conducts to energize the alarm 15 to generate a primary syllable-pause alarm code. The waveform of the signal OSC applied to the base of the transistor 20 is shown as waveform I in FIG. 2.

The primary code generator 30 is a suitable oscillator, such as a digital phase shift multivibrator, and comprises inverter circuits 35–37. The inverter circuits 35–37 are inverting operational amplifiers for providing an odd number of stages to operate as a digital ring oscillator. Interconnecting the output of the inverter circuit 37 with the input of inverter circuit 35 is a feedback network that includes resistors 38 and 39. A resistor 40 interconnects the output of the inverter circuit 35 with the input of the inverter circuit 36. A capacitor 41 is connected between the resistors 38 and 39 and the inverter circuits 36 and 37. The resistors 38 and 39 are current limiting resistors in the feedback loop 42 of the basic code generator 30. The capacitor 41 with the resistors 38 and 39 select a frequency for the primary code generator 30. The resistor 40 is a current limiting resistor.

The conduction of the transistor 20 is base controlled primarily by the primary code generator 30. The transistor 20 conducts when the output of the inverter circuit 36 is at a low potential, which defines the syllable portion of the primary syllable-pause alarm code. The transistor 20 does not conduct when the output of the inverter circuit 36 is at a high potential, which defines the pause portion of the primary syllable-pause alarm code. As the transistor 20 is conductive and non-conductive under the control of the primary code generator 30, the alarm 15 is correspondingly energized and deenergized to provide the primary syllable-pause alarm code as shown as waveform II in FIG. 2.

Figure 2:
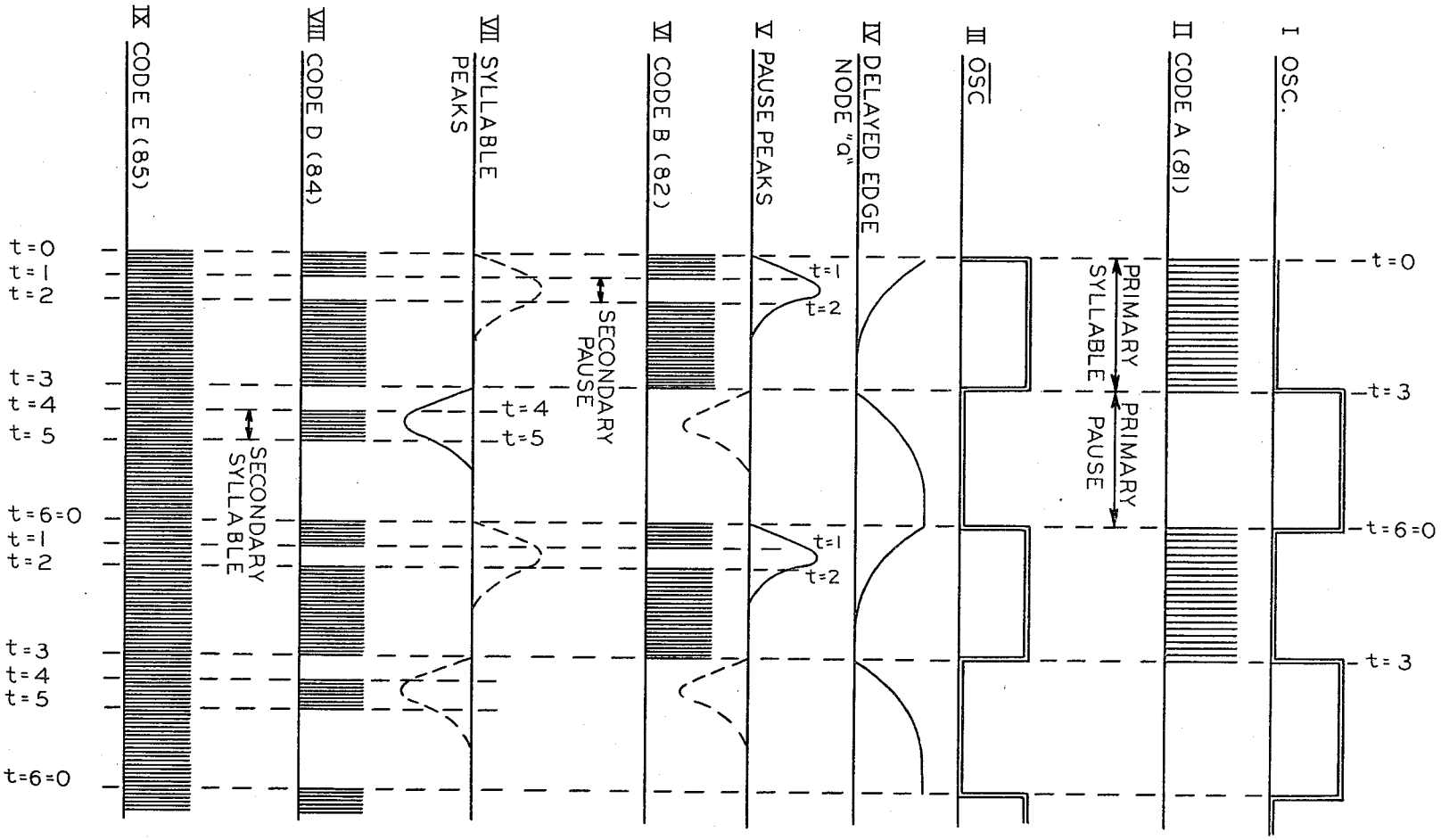
FIG. 2 is a graphical illustration of waveforms of signals employed in the operation of the alarm circuit shown in FIG. 1.

Connected to the base electrode of the transistor 20 by way of a resistor 45 is a secondary syllable circuit 50. The resistors 32 and 45 form a voltage dividing network for applying the signal over the conductor 31 from the primary code generating circuit 30. The secondary syllable circuit 50 turns on the transistor 20 during the pause portion of the primary syllable-pause alarm code for a short time duration. In so doing, the alarm 15 is energized during the pause portion of the primary syllable-pause alarm code as shown in waveform VIII of FIG. 2. The secondary syllable circuit 50 comprises an inverter circuit 51, which is a buffer inverter. Connected to the inverter circuit 51 are a capacitor 52, resistor 53 and resistor 54. The resistor 54 is a current limiting resistor. The capacitor 52 and the resistor 53 form a peaking circuit for the generation of a narrow syllable pulse to turn on the transistor 20 for a short time duration during the pause portion of the primary syllable-pause alarm code to create the secondary syllable. In FIG. 2 is shown waveform VII, which is a syllable peaking pulse applied to the base electrode of the transistor 20, for the generation of the secondary syllable in the pause portion of the primary syllable pause alarm code. When the secondary syllable circuit 50 conducts during the pause portion of the primary syllable-pause alarm code, the transistor 20 conducts to energize the alarm 15. Thus, an additional alarm code is produced that generates a secondary syllable during the pause portion of the primary syllable-pause alarm code. The pause portion of the primary syllable-pause alarm code is divided into a secondary syllable with two pauses of lesser time duration as shown in waveform VIII of FIG. 2.

A secondary pause circuit 65 is connected to the base electrode of the transistor 25. The secondary pause circuit 65 includes an inverter circuit 55, a resistor 56 and a capacitor 66. The inverter circuit 55 is a buffer inverter. The capacitor 66 and the resistor 56 form a peaking circuit for the generation of a narrow pause pulse to turn off the normally conducting transistor 25 for a short time duration during the syllable portion of the primary syllable-pause alarm code to create a secondary pause during the syllable portion of the primary syllable-pause alarm code. In FIG. 2, as waveform V, is shown the narrow pause pulse applied to the base electrode of the transistor 25 and in FIG. 2, as waveform VI, is shown the primary syllable-pause alarm code with a secondary pause in the syllable portion of the primary syllable-pause alarm code. The secondary pause circuit 65 turns off the transistor 25 during the syllable portion of the primary syllable-pause alarm code. In so doing, the alarm is deenergized for a short time duration during the syllable portion of the primary syllable-pause alarm code. When the secondary pause circuit 65 is non-conducting during the syllable portion of the primary syllable-pause alarm code, the transistor 25 does not conduct and the alarm 15 is deenergized. Thus, an additional alarm code is provided that generates a secondary pause during the syllable portion of the primary syllable-pause alarm code. The syllable portion of the primary syllable-pause alarm code is divided into a secondary pause with two syllables of lesser time duration as shown in FIG. 2 as waveform VI.

Interconnecting the primary code generator 30, the secondary syllable circuit 50 and the secondary pause circuit 65 is a delay circuit 70, which provides a delayed application of control voltage to the secondary syllable circuit 50 and the secondary pause circuit 65 under the control of the primary code generator 30 for the initiation and termination of the secondary syllable and for the initiation and termination of the secondary pause in the primary syllable-pause alarm code. The delay circuit 70 comprises an inverter circuit 71, a resistor 72, a resistor 73 and a capacitor 74. The inverter circuit 71 is a buffer inverter. The signal applied to the inverter circuit 71 by the primary code generator 30 is from the output of the inverter circuit 37, while the signal applied to the secondary syllable circuit is from the output of the inverter circuit 71. The buffer inverter circuits 51, 55 and 71 serve to isolate the control nodes of the primary code generator 30 from the switching circuits 20 and 25 and from the application of voltages resulting from alarm conditions. The resistor 73 and the capacitor 74 form an RC time circuit for delaying the positive going and the negative going edges of the output of the inverter circuit 37 before the application thereof to the inverter circuit 71 of the delay circuit 70, as shown in FIG. 2 as waveform IV. The resistor 73 is a current limiting resistor.

Connected to the primary code generator 30, the secondary syllable circuit 50 and the secondary pause circuit 65 is an alarm condition steering circuit 80, which includes terminals 81–86. Depending on the alarm condition, one of the terminals 81–86 will have a voltage applied thereto resulting from a predetermined alarm condition. The application of a voltage resulting from an alarm condition to the terminals 81–86, respectively, results in different discrete syllable-pause alarm codes being produced by the buzzer 15 which represent, respectively, the alarm conditions. The alarm condition steering circuit 80, in the preferred embodiment, is a diode steering circuit, and comprises diodes 90–97. The diodes 90–97 isolate the voltage resulting from alarm conditions from each other and from operating voltages within the alarm circuit 10. The steering circuit 80 also includes a switching transistor 100. A divider network, including resistors 101 and 102, is connected to the base electrode of the switching transistor 100.

In the operation of the alarm circuit 10, the alarm conditions, in the preferred embodiment, have been related to vehicle alarm conditions. If, for example, the vehicle key is left in the ignition, a positive voltage is applied to the terminal 81 to produce from the buzzer 15 the primary syllable-pause alarm code. The voltage applied to the terminal 81 as a result of an alarm condition is impressed on the Vcc terminal of the inverter circuit 35 of the primary code generator over the following path: terminal 81, diode 90, conductor 105, conductor 106, conductor 58 and the Vcc terminal of the inverter circuit 35. When the positive voltage is applied to the Vcc terminal of the inverter circuit 35, the basic code generator 30 generates oscillations in the form of a squarewave, as shown in FIG. 2 as waveform I. The squarewave signal is applied to the base electrode of the transistor 20 over the conductor 31 and through the resistor 32.

The transistor 25 is normally conducting over the following path: terminal 81, diode 90, conductor 105, conductor 106, conductor 58, conductor 57, resistor 56, inverter circuit 55 and the base electrode of the transistor 25. The transistor 20 conducts in accordance with the signal applied to its base electrode to control the energization of the buzzer 15 to produce the primary syllable-pause alarm code. When a positive voltage resulting from an alarm condition is applied to the terminal 81, a positive voltage is applied to control node "a" to clamp the output of the inverter circuit 71 of the delay circuit 70 at a high potential, which disables the operation of the secondary syllable circuit 50 and the secondary pause circuit 65.

The terminal 82 of the steering circuit 80, in the preferred embodiment, is employed for the alarm condition of headlights remaining energized. If, for example, the headlights remain on after the vehicle ignition has been turned off, a positive voltage is applied to the terminal 82 to produce from the buzzer 20 the primary syllable-pause alarm code with a secondary pause syllable so that the audio sound produced by the buzzer 15 is a two syllable sound, as shown in FIG. 2 in the waveform VI.

The application of a positive voltage to the terminal 82 applies an operating potential to the terminal Vcc of the primary code generator 30 to produce oscillations of the primary syllable-pause alarm code over the following path: terminal 82, diode 92, switching transistor 100, conductor 105, conductor 106, conductor 58 and the Vcc terminal of the inverter circuit 35. The voltage applied to the terminal 82 as a result of an alarm condition clamps the inverter circuit 51 of the secondary syllable circuit 50 over the following path: terminal 82, diode 93, conductor 46, resistor 54 and inverter circuit 51. Thus, the potential at the control node "b" is high to inhibit the generation of secondary syllables. The secondary pause generator 65 generates a pause during the syllable portion of the primary syllable-pause alarm cycle produced by the primary code generator 30. An inverted $\overline{OSC}$ signal (shown in FIG. 2 as waveform III) is produced in the output of the inverter circuit 37 and it is applied to the delay circuit 70 over the following path: resistor 73, conductor 31' and inverter circuit 71. The $\overline{OSC}$ signal so applied has a positive going edge at $t=0$ and is delayed in its application to the inverter circuit 71 by the time delay network of resistor 73 and capacitor 74. The delay circuit 70 delays the application of the signal to the secondary pause circuit 65. The negative going edge of the signal (as shown in FIG. 2 as waveform IV) appears at control node "a" and is applied to the secondary pause circuit 65. The negative going edge is peaked by the peaking network of capacitor 66 and resistor 56 before being applied to the inverter circuit 55 of the secondary pause circuit 65. A positive going edge as shown in FIG. 2, as waveform V, is applied to the switching transistor 25 from the output of the inverter circuit 55 of the secondary pause circuit 65. The conduction of the switching transistor 25 is interrupted for a short time duration between $t=1$ and $t=2$. Thus, the buzzer 15 produces an audio alarm code of the primary syllable-pause alarm code and a pause in the syllable portion of the primary syllable-pause alarm code, as shown in FIG. 2 as waveform VI. Thus, a two syllable code has been generated.

In the application of a positive voltage to the terminal 83, there is no audio code generated. The buzzer 15 is silent. The positive voltage applied to the terminal 83 is conducted through the resistor 101 for application to the base electrode of the switching transistor 100. The application of the positive voltage to the base electrode of the switching transistor 100 disables the switching transistor 100. When the switching transistor 100 is disabled, the application of a positive voltage to the terminal 82, in the event of an alarm condition, will not operate the buzzer 15.

The application of a positive voltage to the terminal 84 as a result of an alarm condition, in the exemplary embodiment, produces a code representing that the vehicle gears are in reverse. The application of the positive voltage to the terminal 84 operates the primary code generator 30 over the following path: diode 94, conductor 106, conductor 58 and the Vcc terminal of the inverter circuit 35. The basic code generator 30 oscillates to produce the primary syllable-pause alarm signal. The inverter waveform signal $\overline{OSC}$, as shown in FIG. 2 as waveform III, produced in the output of the primary code generator 30 is applied to the delay circuit 70 over the following path: resistor 73, conductor 31' and inverter circuit 71 of the delay circuit 70. The $\overline{OSC}$ signal so applied has a positive going edge at $t=0$ and is delayed in its application to the inverter circuit 71 by the time delay network of resistor 73 and capacitor 74. The delay circuit 70 delays the application of the signal to the secondary syllable circuit 50 and the secondary pause circuit 65. The negative going edge of the signal (as shown in FIG. 2 as waveform IV) appears at control node "a" and is applied to the secondary pause circuit 65. The negative going edge is peaked by the peaking network of capacitor 66 and resistor 56 before being applied to the inverter circuit 55 of the secondary pause circuit 65. A positive going edge, as shown in FIG. 2 as waveform V, is applied to the switching transistor 25 from the output of the inverter circuit 55 of the secondary pause circuit 65. The conduction of the switching transistor 25 is interrupted for a short time duration between the time t-1 and t-2. Thus, the buzzer 15 produces a pause in the syllable portion of the primary syllable-pause alarm code.

The positive going edge of the signal, as shown in FIG. 2 as waveform IV, appears at the control node "a" and is applied to the secondary syllable circuit 50 at a time t-3. The delayed positive going edge of the signal is peaked by the capacitor 52 and the resistor 53 of the secondary syllable circuit 50. The delayed peak positive going edge is shown in FIG. 2 as waveform V and is applied to the secondary syllable circuit 50. The output of the secondary syllable circuit 50, as shown in FIG. 2 as waveform VII, is applied to the base electrode of the switching transistor 20 for controlling the conduction thereof. The negative going edge of the signal applied to the switching transistor 20 turns on the switching transistor 20 at a time between the time t=4 and 5=5 to produce a syllable of a short time during the pause portion of the primary syllable-pause alarm code between the time t=3 and t=6. Thus, an alarm code is generated by the buzzer 15 of the waveform VIII as shown in FIG. 2. Hence, a three syllable code is generated by the buzzer 15.

When a positive voltage is applied to the terminal 85 resulting from an alarm condition, the buzzer 15 produces a continuous tone. The alarm condition may be optional and may represent, for example, the failure to buckle the seat belts. The positive voltage applied to the terminal 85 will operate the primary code generator 30 by applying a positive voltage to the Vcc terminal of the inverter circuit 35 over the following path: terminal 85, diode 95, conductor 106, conductor 58 and the Vcc terminal of the inverter circuit 35. The primary code generator 30 oscillates to produce the primary syllale-pause waveform, as shown in FIG. 2 as waveform I.

The positive voltage applied to the terminal 85 places a positive voltage at the node "a" through the diode 96 to disable the secondary syllable circuit 50 and to disable the secondary pause circuit 65. The positive voltage applied to the terminal 85 applies a positive voltage to the input 36 at node "c" of the basic code generator 30 through the diode 97 to disable the basic code generator 30 by clamping the basic code generator at the node "c". As a consequence thereof, the base electrode of the switching transistor 20 has a low level voltage applied thereto. This results in the continuous conduction of the switching transistor 20 so that the buzzer 15 produces a continuous audio code as shown in FIG. 2 as waveform IX over the time t=0 to t=6.

When the off switch 62 is closed, the alarm circuit 10 is off or silent. The closing of the off switch 62 applies a ground to the secondary pause circuit 65. The signal applied to the base electrode of the switching transistor 25 through the secondary pause circuit 65 disables the switching transistor 25 so that it does not conduct. The failure of the switching transistor 25 to conduct disables the energization of the buzzer 15.

I claim:

1. An alarm circuit for generating discrete syllable-pause codes representing various alarm conditions comprising:

(a) an alarm;

(b) a first switching circuit connected to said alarm for controlling the operation thereof;

(c) a second switching circuit connected to said alarm for controlling the operation thereof;

(d) a primary code generator connected to said first switching circuit for applying a syllable-pause signal thereto to control the operation of said first switching circuit in accordance with the applied syllable-pause signal; and (e) a steering circuit connected to said primary code generator to activate said primary code generator in response to the application of a voltage resulting from an alarm condition for applying the syllable-pause signal to said first switching circuit and connected to said second switching circuit for operating said second switching circuit in response to the application of the voltage resulting from the alarm condition to operate said alarm for generating a primary syllable-pause code.

2. An alarm circuit for generating discrete syllable-pause codes representing various alarm conditions comprising:

(a) an alarm;

(b) a first switching circuit connected to said alarm for controlling the operation thereof;

(c) a second switching circuit connected to said alarm for controlling the operation thereof;

(d) a primary code generator connected to said first switching circuit for applying a syllable-pause signal thereto to control the operation of said first switching circuit in accordance with the applied syllable-pause signal;

(e) a steering circuit connected to said primary code generator to activate said primary code generator in response to the application of a voltage resulting from an alarm condition for applying the syllable-pause signal to said first switching circuit and connected to said second switching circuit for operating said second switching circuit in response to the application of the voltage resulting from the alarm condition to operate said alarm for generating a primary syllable-pause code; and (f) a secondary syllable circuit connected to said steering circuit and to said first switching circuit, said secondary syllable circuit being operatively controlled by the application of the voltage resulting from an alarm condition to said steering circuit for controlling the operation of said first switching circuit to operate said alarm for generating a primary syllable-pause code with a secondary syllable in the pause portion of the primary syllable-pause code.

3. An alarm circuit for generating discrete syllable-pause codes representing various alarm conditions comprising:

(a) an alarm;

(b) a first switching circuit connected to said alarm for controlling the operation thereof;

(c) a second switching circuit connected to said alarm for controlling the operation thereof;

(d) a primary code generator connected to said first switching circuit for applying a syllable-pause signal thereto to control the operation of said first switching circuit in accordance with the applied syllable-pause signal;

(e) a steering circuit connected to said primary code generator to activate said primary code generator in response to the application of a voltage resulting from an alarm condition for applying the syllable-pause signal to said first switching circuit and connected to said second switching circuit for operating said second switching circuit in response to the application of the voltage resulting from the alarm condition to operate said alarm for generating a primary syllable-pause code; and (f) a secondary pause circuit connected to said steering circuit and to said second switching circuit, said secondary pause circuit being operatively controlled by the application of the voltage resulting from an alarm condition to said steering circuit for controlling the operation of said second switching circuit to operate said alarm for generating a primary syllable-pause code with a secondary pause in the syllable portion of the primary syllable-pause code.

4. An alarm circuit as claimed in claim 2 and comprising a secondary pause circuit connected to said steering circuit and to said second switching circuit, said secondary pause circuit being operatively controlled by the application of the voltage resulting from an alarm condition to said steering circuit for controlling the operation of said second switching circuit to operate said alarm for generating a primary syllable-pause code with a secondary pause in the syllable portion of the primary syllable-pause code.

5. An alarm circuit as claimed in claim 2 and comprising a delay circuit interconnecting said primary code generator and said secondary syllable circuit to control the operation of said secondary syllable circuit to generate the secondary syllable during the pause portion of the primary syllable-pause code.

6. An alarm circuit as claimed in claim 3 and comprising a delay circuit interconnecting said primary code generator and said secondary pause circuit to control the operation of said secondary pause circuit to generate the secondary pause during the syllable portion of the primary syllable-pause code.

7. An alarm circuit as claimed in claim 4 and comprising a delay circuit interconnecting said primary code generator with said secondary syllable circuit and said secondary pause circuit to control the operation of said secondary syllable circuit to produce the secondary syllable during the pause portion of the primary syllable-pause code and to control the operation of said secondary pause circuit to generate the secondary pause during the syllable portion of the primary syllable-pause code.

8. An alarm circuit as claimed in claim 5 wherein said secondary syllable circuit includes a peaking network to apply a signal to said first switching circuit to operate said alarm for generating a secondary syllable in the pause portion of the primary syllable-pause code for a time duration less than the time duration of the pause portion of the primary syllable-pause code.

9. An alarm circuit as claimed in claim 6 wherein said secondary pause circuit includes a peaking network to apply a signal to said second switching circuit to operate said alarm for generating a secondary pause in the syllable portion of the primary syllable-pause code for a time duration less than the time duration of the syllable portion of the primary syllable pause code.

10. An alarm circuit as claimed in claim 7 wherein said secondary syllable circuit includes a peaking network to apply a signal to said first switching to operate said alarm for generating a secondary syllable in the pause portion of the primary syllable-pause code, and wherein said secondary pause circuit includes a peaking network to apply a signal to said second switching circuit to operate said alarm for generating a secondary pause in the syllable portion of the primary syllable-pause code for a time duration less than the time duration of the syllable portion of the primary syllable-pause code.

11. An alarm circuit as claimed in claim 10 wherein said primary code generator comprises a plurality of inverter circuits and a feedback network connected to form a ring oscillator to generate the primary syllable-pause signal.

12. An alarm circuit as claimed in claim 11 wherein said steering network is a diode steering network.

13. An alarm circuit as claimed in claim 12 wherein said first switching circuit includes a switching transistor and said second switching circuit includes a switching transistor.

14. An alarm circuit responsive to the application of a voltage from at least one of a plurality of external conditional voltage sources for generating a plurality of discrete audio syllable-pause codes as a function of the applied conditional voltages, said alarm circuit comprising:

(a) audio means for generating an audio signal when energized;

(b) first switching means connected in series with said audio means for energizing said audio means to generate a syllable when conducting, and for de-energizing said audio means to produce a pause when non-conducting;

(c) second switching means connected in series with said audio means for energizing said audio means when conducting and for de-energizing said audio means to produce a pause when non-conducting, said second switching means being arranged to normally conduct;

(d) oscillator means for producing a periodically varying output for controlling the condition of said first switching means for generating a sequence of primary syllables and pauses, said first switching means conducting during one portion of the periodically varying output to generate the primary syllable portion of the duty-cycle and said first switching means being non-conductive during another portion of the periodically varying output to generate the primary pause portion of the duty-cycle;

(e) a delay circuit responsive to said oscillator means for providing a delayed edge of one polarity during the primary syllable portion of the duty-cycle, and for providing a delayed edge of another polarity during the primary pause portion of the duty-cycle;

(f) secondary pause means responsible to the delayed edge of the one polarity and to at least one of the external condition voltage sources for disabling said second switching means during the primary syllable portion of the duty-cycle to generate a secondary pause; and (g) secondary syllable means responsive to the delayed edge of said other polarity and to at least one of the external conditional voltage sources for rendering said first switching means conductive during the primary pause portion of the duty-cycle to generate a secondary syllable.

15. An alarm circuit as claimed in claim 14 wherein a first voltage of the external conditional voltage sources applied to said secondary pause means and said secondary syllable means disables the generation of a secondary pause and a secondary syllable for the generation of the primary syllable-pause code.

16. An alarm circuit as claimed in claim 15 wherein the first voltage clamps the output of said delay circuit. to disable the generation of the delayed edge of one polarity and the delayed edge of the other polarity.

17. An alarm circuit as claimed in claim 15 wherein a second voltage of the external conditional voltage sources applied to said secondary syllable means disables said secondary syllable means for the generation of a primary syllable-pause pattern with a secondary pause.

18. An alarm circuit as claimed in claim 17 wherein a third voltage of the external conditional voltage sources applied to said secondary pause means disables the secondary pause means for the generation of a primary syllable-pause code with a secondary syllable.

19. An alarm circuit as claimed in claim 14 wherein said secondary syllable means and said secondary pause means are operative for said audio means to produce a primary syllable-pause code with a secondary syllable and a secondary pause.

20. An alarm circuit as claimed in claim 18 wherein a fourth voltage of the external conditional voltage sources is applied to said oscillator means for said audio means to produce a continuous syllable.

21. An alarm circuit as claimed in claim 20 wherein a fifth voltage of the external conditional voltage sources is applied to said secondary pause means to disable said audio means for producing a continuous pause.

22. An alarm circuit as claimed in claim 21 wherein the fifth voltage disables said second switching means to produce the continuous pause.

23. An alarm circuit as claimed in claim 18 wherein said oscillator means is activated by the application of the first, the second, and the third voltages of the external conditional voltage sources.

24. An alarm circuit as claimed in claim 20 wherein the energization of said audio means is controlled by the first, the second, the third and the fourth voltages of the external conditional voltage sources.

* * * * *